US011034482B2

(12) United States Patent
Rudolf

(10) Patent No.: US 11,034,482 B2
(45) Date of Patent: Jun. 15, 2021

(54) CONTAINER WITH NON-SQUARED EDGES

(71) Applicant: PHILIP MORRIS PRODUCTS S.A., Neuchatel (CH)

(72) Inventor: David Rudolf, Kutna Hora (CZ)

(73) Assignee: Philip Morris Products S.A., Neuchatel (CH)

( * ) Notice: Subject to any disclaimer, the term of this patent is extended or adjusted under 35 U.S.C. 154(b) by 259 days.

(21) Appl. No.: 15/740,470

(22) PCT Filed: Jul. 29, 2016

(86) PCT No.: PCT/EP2016/068254
§ 371 (c)(1),
(2) Date: Dec. 28, 2017

(87) PCT Pub. No.: WO2017/021342
PCT Pub. Date: Feb. 9, 2017

(65) Prior Publication Data

US 2018/0186504 A1 Jul. 5, 2018

(30) Foreign Application Priority Data

Jul. 31, 2015 (EP) ..... 15179420

(51) Int. Cl.
*B65D 5/42* (2006.01)
*B65D 85/10* (2006.01)
(Continued)

(52) U.S. Cl.
CPC ..... *B65D 5/4266* (2013.01); *B31B 50/252* (2017.08); *B65D 5/0218* (2013.01);
(Continued)

(58) Field of Classification Search
CPC .. B65D 5/4266; B65D 5/0218; B65D 85/104; B65D 85/1054; B65D 5/6688;
(Continued)

(56) References Cited

U.S. PATENT DOCUMENTS 3,526,566 A * 9/1970 McIlvain, Jr. ..... B31F 1/0012 428/121
4,655,366 A * 4/1987 Sykes ..... B65D 5/445 220/648
(Continued)

FOREIGN PATENT DOCUMENTS

CA 2437936 4/2007
DE 10106548 8/2002
(Continued)

OTHER PUBLICATIONS

PCT/EP2016/068254 International Search Report and Written Opinion dated Sep. 7, 2016 (11 pages).
(Continued)

*Primary Examiner* — Steven A. Reynolds
(74) *Attorney, Agent, or Firm* — Mueting Raasch Group

(57) ABSTRACT

Container for consumer articles, the container being at least partially formed from a laminar blank (100), the laminar blank defining a portion of the container, which includes: a first planar wall (101); a second planar wall (102) connected to the first planar wall by a first modified edge portion (104); and a third planar wall (103) connected to the first planar wall by a second modified edge portion (105). The first modified edge portion is defined by an ablation area, on its inner surface, having one or more ablated lines (201-206) each having a residual thickness less than the thickness (T) of the laminar blank, the first modified edge portion an end portion tapering from a width (W) of the first portion to a point at the junction with the second modified edge portion. The second modified edge portion is defined by a plurality of creasing lines (300).

11 Claims, 3 Drawing Sheets

(51) Int. Cl.
*B31B 50/25* (2017.01)
*B65D 5/02* (2006.01)
*B65D 5/66* (2006.01)

(52) U.S. Cl.
CPC ..... *B65D 5/6688* (2013.01); *B65D 85/10484* (2020.05); *B31B 2241/003* (2013.01)

(58) Field of Classification Search
CPC ..... B65D 85/1045; B65D 85/10484; B31B 50/252; B31B 2241/003
USPC ..... 206/268, 242, 265, 271, 273; 229/198.2, 229/16.1, 182.1, 930
See application file for complete search history.

(56) References Cited

U.S. PATENT DOCUMENTS

| | | | | |
|---|---|---|---|---|
| 5,143,282 | A * | 9/1992 | Pham | B65D 5/6691 229/148 |
| 5,833,060 | A * | 11/1998 | Draghetti | B65D 85/1045 206/268 |
| 5,924,627 | A * | 7/1999 | Wilder | B65D 5/4266 229/182.1 |
| 6,079,556 | A | 6/2000 | Draghetti | |
| 6,276,600 | B1 * | 8/2001 | Rigby | B65D 85/1045 206/273 |
| 7,044,294 | B2 * | 5/2006 | Lutzig | B65D 5/6691 206/259 |
| 7,896,225 | B2 * | 3/2011 | Bray | B65D 85/1045 229/146 |
| D635,851 | S * | 4/2011 | Pipes | D9/433 |
| 8,418,846 | B2 * | 4/2013 | Tanbo | B31F 1/0012 206/268 |
| 8,608,051 | B2 * | 12/2013 | Focke | B65D 5/029 206/259 |
| 10,059,505 | B2 * | 8/2018 | Tanbo | B65D 5/4266 |
| 2004/0144661 | A1 * | 7/2004 | Lutzig | B65D 5/6691 206/268 |
| 2004/0178089 | A1 * | 9/2004 | Draghetti | B65D 85/1045 206/242 |
| 2005/0029131 | A1 * | 2/2005 | Draghetti | B65D 85/1045 206/259 |
| 2009/0242435 | A1 | 10/2009 | Van Rijssel | |
| 2015/0090618 | A1 | 4/2015 | Marchitto | |

FOREIGN PATENT DOCUMENTS

| | | |
|---|---|---|
| DE | 102009011918 | 9/2010 |
| DE | 102010027140 | 1/2012 |
| EP | 0764595 | 3/1997 |
| EP | 0930245 | 7/1999 |
| EP | 2105385 | 9/2009 |
| JP | S54 7925 | 1/1979 |
| JP | 2004-526439 | 9/2004 |
| WO | WO 2013/190494 | 12/2013 |
| WO | WO 2016/107900 | 7/2016 |
| WO | WO 2016/107929 | 7/2016 |
| WO | WO 2016/156539 | 10/2016 |
| WO | WO 2016/189133 | 12/2016 |
| WO | WO 2017/021343 | 2/2017 |

OTHER PUBLICATIONS

European Extended Search Report for Application No. 15179420.3-1708 dated Dec. 9, 2015 (12 pages).
Office Action issued in Singapore for Application No. 11201709319S dated Dec. 17, 2018 (8 pages).
Office Action issued in Japan for Application No. 2018-503145 dated Jul. 27, 2020 (5 pages). English translation included.

* cited by examiner

CONTAINER WITH NON-SQUARED EDGES

This application is a U.S. National Stage Application of International Application No. PCT/EP2016/068254 filed Jul. 29, 2016, which was published in English on Feb. 9, 2017, as International Publication No. WO 2017/021342 A1. International Application No. PCT/EP2016/068254 claims priority to European Application No. 15179420.3, filed Jul. 31, 2015.

The present invention relates to a container for consumer goods and to a blank for forming such container, which find particular application for holding consumer goods, such as smoking articles (for example cigarettes).

Smoking articles such as cigarettes and cigars are usually provided in soft-pack packs or hard-pack packs, such as flip-top boxes or hinge-lid boxes. These typically have a box part having a box front wall, a box rear wall, box side walls and a box base. They also usually have a lid part with a lid front wall, a lid rear wall, lid side walls and a lid top side. The lid part is typically hinged to the box part along a hinge line extending across a back wall of the container. The hinge line is usually provided as a pre-folded line, a crease line or a score line.

For hard-pack packs, it is known to round off or chamfer certain corners of the box and lid to give the container a distinctive appearance. This has typically been achieved in the past by providing creasing lines or score lines in the blank at the areas forming the edges of the container. These lines allow the blank to be folded in such a way that the corner does not sharply bend but instead progressively bends between two adjacent walls.

However, where a container comprises adjacent rounded or bevelled edges forming an angle, such as an orthogonal angle, the strength and finish of the container may at times be impacted during folding of the blank to form the container. In some cases, a hole or gap can even be formed at the junction between the adjacent rounded or bevelled edges. Thus, not only is the visual and tactile perception of the container impacted, but also the container may be structurally damaged.

Thus, it would be desirable to provide a container for consumer goods that is less prone to being damaged during the assembly operation and that has an improved look and a smoother feel. In particular, it would be desirable that one such container be easy to assemble using standard packing apparatus and techniques, without the requirement for significant changes to existing machines and methods. At the same time, it would be desirable to provide a blank for manufacturing a container for consumer goods that makes the production and assembly process easier, more flexible and less likely to cause damages in the assembled container.

According to a first aspect of the present invention, there is provided a container for consumer articles, the container being at least partially formed from a laminar blank, the laminar blank defining a portion of the container, which comprises: a first planar wall; a second planar wall connected to the first planar wall by a first modified edge portion; and a third planar wall connected to the first planar wall by a second modified edge portion. The longitudinal direction of the first modified edge portion is transverse to the longitudinal direction of the second modified edge portion. The first modified edge portion and the second modified edge portion form, when the container is assembled from the laminar blank, adjacent edge portions of the container meeting at a junction. Each of the first modified edge portion and the second modified edge portion has a length in the longitudinal direction of the respective modified edge portion and a respective width that extends transversely to the length. At least one of the first modified edge portion and the second modified edge portion comprises a first portion and an end portion extending from the first portion, the end portion tapering from a width (W) of the first portion to a point at the junction with the other one of the first modified edge portion and the second modified edge portion. At least one of the first modified edge portion and the second modified edge portion is defined by a plurality of creasing lines in the laminar blank.

According to a second aspect of the present invention, there is provided a laminar blank for forming a container for consumer articles, the laminar blank comprising: a first planar wall; a second planar wall connected to the first planar wall by a first modified edge portion; and a third planar wall connected to the first planar wall by a second modified edge portion. The longitudinal direction of the first modified edge portion is transverse to the longitudinal direction of the second modified edge portion. The first modified edge portion and the second modified edge portion form, when the container is assembled from the laminar blank, adjacent edge portions of the container meeting at a junction. Each of the first modified edge portion and the second modified edge portion has a length in the longitudinal direction of the respective modified edge portion and a respective width that extends transversely to the length. At least one of the first modified edge portion and the second modified edge portion comprises a first portion and an end portion extending from the first portion, the end portion tapering from a width (W) of the first portion to a point at the junction with the other one of the first modified edge portion and the second modified edge portion. At least one of the first modified edge portion and the second modified edge portion is defined by a plurality of creasing lines in the laminar blank.

It shall be appreciated that any features described with reference to one aspect of the present invention are equally applicable to any other aspect of the invention.

In contrast to known blanks/containers having two adjacent non-squared (for example, rounded or bevelled) modified edge portions, at least one of the modified edge portions tapers towards the intersection with an adjacent modified edge portion. In more detail, the at least one modified edge portion comprises a first portion, for example one having a substantially constant width over at least a part of its length, and at least a tapered end portion extending from the first portion to the intersection with another modified edge portion of the same planar wall of the container.

Because the interference between adjacent modified edge portions is limited, if not eliminated altogether, the risk of damaging the blank/container during the folding operation is significantly reduced. Thus, bending of the blank when forming the container is easier and results in the formation of surfaces that are smoother to the touch. At the same time, the strength of the container at rounded/bevelled edges may be better preserved.

Furthermore, advantageously, by forming at least one of the modified edge portions from a plurality of creasing lines, said modified edge portion can be formed using existing machinery and techniques. For example, if the said modified edge portion forms a longitudinal edge portion of the container—such as one disposed between a side wall and a front wall or rear wall of the container—then said longitudinal edge portion can be formed by machinery and techniques that are already utilized for conventional round corner or beveled edge containers.

Accordingly, the present invention provides a way to form a container having adjacent non-squared edge portions, such as rounded or bevelled edge portions, on conventional packaging machinery, where the risk of forming holes or gaps in the container during the assembly operation is greatly reduced, if not eliminated entirely.

The term "modified edge portion" is used herein to refer in particular to an edge portion of the container having a non-square shape as viewed in cross-section. This may for example refer to a "curved edge portion", that is an edge portion of the container having an arc-like shape as viewed in cross-section. By the term "arc-like" reference is made to any non-straight line, including circular arc, parabolic arc, hyperbolic arc, or elliptical arc. Further, this may for example refer to a "bevelled edge portion", that is an edge portion of the container that has, as viewed in cross-section, a substantially straight shape forming an angle between 0 and 90 degrees with the adjacent walls of the container.

The term "creasing line" is used herein to refer to a line along the laminar blank that has been mechanically deformed, for example by mechanical pressing or rolling, to form a line of weakness in the blank about which the blank can be folded. In particular, the line of weakness is formed without removing material.

The term "extending substantially in the longitudinal direction of the modified edge portion" is used here in to mean that the creasing line or the ablation line extends from a first point of the modified edge portion to a second point of the modified edge portion that together lie on an imaginary straight line that forms an angle of less than 20 degrees with the longitudinal direction of the modified edge portion.

The expression "distance between creasing lines in a pair of creasing lines" is used to describe the width of the portion of the modified edge portion that resides between two creasing lines in a single pair of creasing lines. Such distance is construed as being measured along the width of the modified edge portion and between the respective symmetry axes of the creasing lines. In practice, because the creasing lines extend along the length of the modified edge portion, the distance between adjacent creasing lines in a single pair is measured substantially perpendicular to the lines themselves.

The expression "distance between adjacent pairs of creasing lines" is used to describe the width of the portion of modified edge portion separating two adjacent pairs of creasing lines. Such distance is construed as being measured along the width of the modified edge portion. In practice, because the creasing lines extend along the length of the modified edge portion, the distance between adjacent pairs of creasing lines is measured substantially perpendicular to the main axis of the creasing lines.

The term "proximate to" is used throughout this specification to describe a pair of creasing lines immediately adjacent another element of the container, such as a planar wall thereof. In practice, in some embodiments, one of the creasing lines of a first pair adjacent a first planar wall of the container extends substantially at the border between the planar wall of the container and the modified edge portion connecting the planar wall to another planar wall of the container.

The term "inner surface" is used throughout the specification to refer to the side of a portion of the blank that, once the container is assembled, faces towards the interior of the container, for example towards the consumer goods, when the container is closed. Thus, the inner surface is not directly visible for the consumer when the container is closed. The term "outer surface" is used throughout the specification to refer to the side of a portion of the blank that, once the container is assembled, faces towards the exterior of the container.

The term "ablation area" is used herein to refer to the minimum area of the blank that encloses all ablated lines on a modified edge portion.

The term "ablated line" is used herein to refer to an area of a modified edge portion from which material has been ablated (for example, removed by means of a laser beam or a blade) from a surface of the laminar blank or container. Accordingly, the residual thickness of an ablated line is less than the thickness (T) of the laminar blank. Preferably, an ablated line is provided as a groove within the blank. This may be formed with a linear ablation tool, such as a laser or a blade. In embodiments where all the ablated lines are defined by parallel grooves within the blank, the area of the ablation area may be regarded as the area enclosing all the grooves on a modified edge portion. Thus, in those embodiments, the width of the ablation area may be regarded as extending transversely to the grooves, from the first to the last of the grooves on a modified edge portion.

In the present specification, the term "slanted" is used to describe a section of an ablated line or a creasing line that extends along a direction forming a non null angle with respect to a reference direction, for example the longitudinal direction of the ablation area, or the axis of a wall of the container. For example, a "slanted" section of an ablated line or a creasing line may extend along said direction in its entirety. In other words, a "slanted" section of an ablated line or a creasing line may extend along a substantially straight line. As an alternative, the direction along which a "slanted" section of an ablated line or a creasing line extends may vary. Thus, a "slanted" section of an ablated line or a creasing line may substantially extend along a polyline or a curved line.

The term "residual thickness" is used herein to refer to the minimum distance measured between two opposite surfaces of the laminar blank or of a wall of the container formed from the blank. In practice, the distance at a given location is measured along a direction locally perpendicular to the opposite surfaces. The "residual thickness" of an ablated line may be constant over the ablated line if material is removed homogenously substantially all over the ablated line (flat profile). Alternatively, the residual thickness of the ablated line may vary across a width of the ablated line, if material is removed non-homogeneously over the ablated line (e.g. V-shaped, U-shaped grooves).

As used herein, the terms "front", "back", "upper", "lower", "top", "bottom" and "side", refer to the relative positions of portions of containers according to the invention and components thereof when the container is in an upright position with the access opening at the top of the container. In particular, where the container is a hinged lid container, this refers to the container being in an upright position with the lid in the closed position and the hinge line at the back of the container. When describing containers according to the present invention, these terms are used irrespective of the orientation of the container being described.

The term "spring-back force" is a known term of art for referring to a particular property of a laminar blank. It is sometimes referred to as 'the crease recovery' and means the force (N) required to hold a scored sample that is folded at 90 degrees for a 15-second period. The measurement is made at the end of the 15-second period. The spring-back force of a portion of a laminar blank can be measured using a known PIRA Crease and Board Stiffness Tester (commercially available for example from Messmer and Buchel, UK). As is known in the art, to measure the spring-back force of a modified edge portion of a container, a sample of the portion to be tested should first be removed from the laminar blank. For round corner packs, for the purposes of the present invention the spring-back force of a pack is assessed using a sample measuring 38±1 millimetres by 38±0.5 millimetres, with the corner forming portion being positioned 21±0.5 millimetres from one side of the blank. The blank should be conditioned at 22 degrees Celsius and 60 percent relative humidity for at least 24 hours prior to testing.

As noted above, at least one of the first modified edge portion and the second modified edge portion comprises a first portion and an end portion extending from the first portion, the end portion tapering from a width (W) of the first portion to a point at the junction with the other one of the first modified edge portion and the second modified edge portion. In some preferred embodiments, both of the first modified edge portion and the second modified edge portions comprise a respective first portion and a respective end portion extending from the respective first portion and tapering from a width of the respective first portion to a point at the junction with the other one of the first modified edge portion and the second modified edge portion. This is thought to minimise the interaction between the adjacent modified edge portions, and so the risk of damaging the container during the assembly process may be particularly limited. In addition, the finish and look of the container can be advantageously enhanced.

The first modified edge portion and the second modified edge portion may each be respectively defined by a plurality of creasing lines in the laminar blank.

In some particularly preferred embodiments, the second modified edge portion is defined by a plurality of creasing lines in the laminar blank. Preferably, the plurality of creasing lines extend in the longitudinal direction of the second modified edge portion over the whole length of the second modified edge portion. In such embodiments, the plurality of creasing lines preferably extend in parallel in the longitudinal direction of the second modified edge portion over the whole length of the second modified edge portion. This enhances the definition of a curved or beveled edge portion defined by the creasing lines. The greater the number of creasing lines and greater the density of creasing lines, the more the edge portion will form a curved shape when the container is assembled. Accordingly, in some preferred embodiments, the second modified edge portion is defined by at least four creasing lines in the laminar blank, the at least four creasing lines extending in the longitudinal direction of the second modified edge portion over the whole length of the second modified edge portion. Advantageously by forming the second modified edge portion from a plurality of creasing lines, the second modified edge portion can be formed using existing machinery and techniques. For example, if the second modified edge portion forms a longitudinal edge portion of the container—such as one disposed between a side wall and a front wall or rear wall of the container—then said longitudinal edge portion can be formed by machinery and techniques that are already utilized for conventional round corner or beveled edge containers.

As noted above, in some embodiments, both the first modified edge portion and the second modified edge portion may each be respectively defined by a plurality of creasing lines in the laminar blank. However, in some preferred embodiments, one of the first modified edge portion or the second modified edge portion is instead defined by a plurality of ablated lines on the inner surface of said modified edge portion.

In some particularly preferred embodiments, the second modified edge portion is defined by a plurality of creasing lines in the laminar blank, and the first modified edge portion has an inner surface defining an ablation area that comprises one or more ablated lines each having a residual thickness less than the thickness (T) of the laminar blank.

In particular, according to a further aspect of the invention, there is provided a container for consumer articles, the container being at least partially formed from a laminar blank, the laminar blank defining a portion of the container, which comprises: a first planar wall; a second planar wall connected to the first planar wall by a first modified edge portion; and a third planar wall connected to the first planar wall by a second modified edge portion; the longitudinal direction of the first modified edge portion being transverse to the longitudinal direction of the second modified edge portion; the first modified edge portion and the second modified edge portion forming, when the container is assembled from the laminar blank, adjacent edge portions of the container meeting at a junction; wherein each of the first modified edge portion and the second modified edge portion has a length in the longitudinal direction of the respective modified edge portion and a respective width that extends transversely to the length; wherein the first modified edge portion is defined by an ablation area on its inner surface, the ablation area comprising one or more ablated lines each having a residual thickness less than the thickness (T) of the laminar blank, the first modified edge portion further comprising a first portion and an end portion extending from the first portion, the end portion tapering from a width (W) of the first portion to a point at the junction with the second modified edge portion; and wherein the second modified edge portion is defined by a plurality of creasing lines in the laminar blank.

Such arrangements can advantageously allow the second modified edge portion to be formed using existing creasing machinery and techniques, whilst adopting advantages (such as flexibility of design) associated with ablation technology, for forming the first modified edge portion. Accordingly, where the first modified edge portion has an inner surface defining an ablation area that comprises one or more ablated lines each having a residual thickness less than the thickness (T) of the laminar blank, preferably the first modified edge portion comprises a first portion and an end portion extending from the first portion, the end portion tapering from a width (W) of the first portion to a point at the junction with the second modified edge portion. Preferably, the ablation area of the first modified edge portion comprises a first ablated line and a second ablated line extending in parallel in the longitudinal direction of the first modified edge portion within the first portion of the ablation area; and wherein each of the first and second ablated lines is arranged proximate to a respective one of the first planar wall and the second planar wall. Preferably, each of the first ablated line and the second ablated line comprises a slanted section extending over at least part of the tapering end portion of the first modified edge portion, along a direction forming a non null angle with the longitudinal direction of the first modified edge portion. Advantages associated with ablation technology, such as flexibility of design, can therefore be utilized to form the potentially more complex tapering shape of the first modified edge portion, whilst still utilizing existing creasing machinery and techniques for forming the second modified edge portion.

As noted above, utilising one or more ablated lines to define the first modified edge portion provides several advantages. For example, because the outer surface of the blank is unaffected by the ablation process, the resulting outer surface of the container about the first modified edge portion is smooth upon visual and tactile inspection on the part of the consumer. Further, because this smooth surface can be obtained with a relatively small number of ablated lines, and therefore with limited material removal, the strength of the container at the rounded or beveled edge portion may be adjusted, so that appearance and resistance of the container are both advantageously improved.

Advantageously, the blank may be manufactured by precisely removing material from the round corner portion with a linear ablation tool (e.g. laser, blade). Repeated passages of the ablation tool over a given portion of the blank results in the controlled removal of a greater percentage of material, that is in a reduced residual thickness.

Furthermore, as the blank is bent into shape at the first modified edge portion, a portion of the total deflection is absorbed by each reduced thickness ablated line, so that the resulting container edge advantageously gets to assume the desired shape more smoothly than it would be if it were formed with sharp creases. This is particularly relevant where the first modified edge portion has a tapered profile that requires a precise shape to be formed in the edge portion of the blank. The weakness created in the blank by the ablated lines allows such a precise shape to be formed without needing any or major adjustment of the bending forces that are applied to the planar walls of the blank that are connected by the modified edge portion. Accordingly, whilst the first modified edge portion may be defined by ablated lines that may themselves need to be created using non-conventional techniques, the actual act of folding the blank about said edge portion, does not itself need to be greatly adjusted (if at all), and consequently containers according to the present invention can still be easily assembled on conventional packing machinery.

In some embodiments, the first modified edge portion preferably comprises a first pair of ablated lines extending in parallel the longitudinal direction of the modified edge portion over at least part of the tapering end portion of the ablation area, and a second pair of ablated lines comprising respective slanted sections forming a non null angle with the first pair of ablated lines. The ablated lines in the second pair of ablated lines are symmetrical with respect to the ablated lines in the first pair of ablated lines.

Where a modified edge portion is defined by one or more ablation lines on the inner surface of said modified edge portion, preferably, each of the ablation lines has a residual thickness of at least about 5 percent of the thickness (T) of the blank. More preferably, each of the ablation lines has a residual thickness of at least about 10 percent of the thickness (T) of the blank. Even more preferably, each of the ablation lines has a residual thickness of at least about 20 percent of the thickness (T) of the blank. In addition, or as an alternative, each of the ablation lines has preferably a residual thickness of less than about 50 percent of the thickness (T) of the blank. More preferably, each of the ablation lines has a residual thickness of less than about 40 percent of the thickness (T) of the blank. Even more preferably, each of the ablation lines has preferably a residual thickness of less than about 30 percent of the thickness (T) of the blank. In some particularly preferred embodiments, each of the ablation lines has preferably a residual thickness of about 20 percent of the thickness (T) of the blank.

Where a modified edge portion is defined by one or more ablation lines on the inner surface of said modified edge portion, preferably, the ablated width of each ablated line is at least about 0.01 millimetres. More preferably, the ablated width of each ablated line is at least about 0.05 millimetres. In addition, or as an alternative, the ablated width of each ablated line is less than about 0.4 millimetres. More preferably, the ablated width of each ablated line is less than about 0.2 millimetres. In some preferred embodiments, the ablated width of each ablated line is from about 0.01 millimetres to about 0.4 millimetres. Even more preferably, the ablated width of each ablated line is from about 0.05 millimetres to 0.2 millimetres.

Preferably, the container has a spring-back force of less than about 10 milliNewton metres between the two planar walls that are connected by a modified edge portion. Preferably, the blank has a spring-back force of less than about 10 milliNewton metres between two planar walls that are connected by a modified edge portion, more preferably less than about 9 milliNewton metres, even more preferably less than about 7 milliNewton metres. Preferably, the blank has a spring-back force of at least about 3 milliNewton metres between two planar walls that are connected by a modified edge portion, more preferably at least about 4 milliNewton metres.

In some preferred embodiments, the second modified edge portion is defined by a plurality of creasing lines in the laminar blank. In such embodiments, the plurality of creasing lines comprises a plurality of pairs of creasing lines, all the creasing lines extending in parallel in the longitudinal direction of the second modified edge portion, wherein the distance (X) between two creasing lines in each pair as measured along the width (W) of the modified edge portion is less than the distance (Y) between two adjacent pairs of creasing lines as measured along the width (W) of the modified edge portion.

Surprisingly, it has been found that such an arrangement of creasing lines, when forming a rounded edge portion of a container, is easier, and may result in the formation of an outer surface of the container that is smoother upon visual and tactile inspection on the part of the consumer. Further, the rounded edge portion of the container effectively approximates the theoretical, reference rounded shape with a relatively small number of creasing lines. Thus, at the same time, the strength of the container at the rounded edges may be better preserved.

Preferably, the distance (X) between two creasing lines in each pair is less than about 1 millimetre. More preferably, the distance (X) between two creasing lines in each pair is less than about 0.8 millimetres. In addition, the distance (X) between two creasing lines in each pair is preferably at least about 0.4 millimetres. More preferably, the distance (X) between two creasing lines in each pair is preferably at least about 0.6 millimetres.

Preferably, the distance (Y) between two adjacent pairs of creasing lines is less than about 1.2 millimetres. More preferably, the distance (Y) between two adjacent pairs of creasing lines is less than about 1 millimetre. In addition, or as an alternative, the distance (Y) between two adjacent pairs of creasing lines is at least about 0.6 millimetres. More preferably, the distance (Y) between two adjacent pairs of creasing lines is at least about 0.8 millimetres.

Without wishing to be bound by theory, it has been identified that a particular ratio of the distance (X) between two creasing lines in each pair, with respect to the distance (Y) between two adjacent pairs of creasing lines can provide particularly smooth looking round corner portions, with relatively few creasing lines. In particular, preferably the distance (X) between two creasing lines in each pair is between about 70 percent and about 85 percent of the distance (Y) between two adjacent pairs of creasing lines, more preferably between about 75 percent and about 80 percent of the distance (Y) between two adjacent pairs of creasing lines.

In some preferred embodiments, the second modified edge portion comprises at least a first pair of creasing lines proximate to the first planar wall and a second pair of creasing lines proximate to the third planar wall.

In some alternative embodiments, the modified edge portion comprises a first single creasing line and a second single creasing line adjoining the first planar wall and the third planar wall, respectively. Further, the modified edge portion comprises at least a first pair of creasing lines and a second pair of creasing lines extending between the first and the second single creasing line. The distance (Z1) between the first pair of creasing lines and the first single creasing line or the distance (Z2) between the second pair of creasing lines and the second single creasing line or both is greater than the distance (X) between two creasing lines in each pair as measured along the width (W) of the modified edge portion. Preferably, the distance (Z1) between the first pair of creasing lines and the first single creasing line is substantially equal to the distance (Z2) between the second pair of creasing lines and the second single creasing line.

The distance (Z1) between the first pair of creasing lines and the first single creasing line is preferably at least about 0.6 millimetres, more preferably at least 0.8 millimetres. Preferably, the distance (Z1) between the first pair of creasing line and the first single creasing line is less than about 1.2 millimetres.

Preferably, each creasing line has a width (CW) of at least about 0.05 millimetres, more preferably of at least about 0.1 millimetres, even more preferably of at least about 0.2 millimetres. In addition, or as an alternative, each creasing line has a width (CW) of less than about 0.6 millimetres, preferably less than about 0.5 millimetres, preferably less than about 0.4 millimetres, preferably less than about 0.3 millimetres, even more preferably less than about 0.2 millimetres. In some preferred embodiments, each creasing line has a width (CW) of from about 0.05 millimetres to about 0.4 millimetres, more preferably of from about 0.1 to about 0.3 millimetres.

In some embodiments, the laminar blank defines a portion of the container that comprises a first planar wall, a second planar wall connected to the first planar wall by a first modified edge portion; a third planar wall connected to the first planar wall by a second modified edge portion; and a fourth planar wall connected to the first planar wall by a third modified edge portion. The longitudinal direction of the first modified edge portion is transverse to the longitudinal direction of the second modified edge portion and to the longitudinal direction of the third modified edge portion. The longitudinal direction of the second modified edge portion is substantially parallel to the longitudinal direction of the third modified edge portion. When the container is assembled from the laminar blank, the first modified edge portion and the second modified edge portion form adjacent edge portions of the container meeting at a first junction. Similarly, in the assembled container, the first modified edge portion and the third modified edge portion form adjacent edge portions of the container meeting at a second junction. Preferably, the third modified edge portion (A3) is defined by a plurality of creasing lines in the laminar blank extending in the longitudinal direction of the third modified edge portion over the whole length of the third modified edge portion. Preferably, the creasing lines of the third modified edge portion have the same or similar features to those of the second modified edge portion.

Blanks according to the present invention find application for the manufacture of containers for consumer goods, in particular elongate consumer goods such as smoking articles. However, they can also be used for several other types of consumer goods, such as confectionary. In particular, a container may be formed from a blank according to the present invention, wherein the laminar blank forms at least a part of the container comprising a box portion having a box front wall, a box rear wall and box side walls extending between the box front wall and the box rear wall, and wherein the modified edge portions connect at least one of the box front wall and the box rear wall to the box side walls. As an alternative, a container may be formed from a blank according to the present invention, wherein the laminar blank forms at least a part of the container comprising a lid portion having a lid front wall, a lid rear wall and lid side walls extending between the lid front wall and the lid rear wall, and wherein the modified edge portions connect at least one of the lid front wall and the lid rear wall to the lid side walls.

Blanks according to the present invention may be formed from any suitable material or combination of materials, including, but not limited to, cardboard, paperboard, plastic, metal, or combinations thereof. Preferably, the blank is a laminar cardboard blank having a weight of between about 100 grams per square metre and about 350 grams per square metre. In preferred embodiments, the blank has a thickness of from about 200 to about 400 micrometres, more preferably from 250 micrometres to 350 micrometres.

A container formed from a blank according to the present invention may optionally comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

Further, the consumer articles may be provided within one such container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which consumer goods can be removed when a lid of the container is in a respective open position.

The blank is preferably for forming a rectangular parallelepiped container comprising two wider walls spaced apart by two narrower walls. A hinge lid container formable from a blank according to the container shall typically comprise two longitudinal rounded or bevelled edges on the front wall, and/or two longitudinal rounded or bevelled edges on the back wall. These may optionally be in combination with one or more rounded or bevelled transverse edges.

Where the container comprises bevelled edges, preferably the bevelled edges have a width of between about 1 mm and about 10 mm, preferably between about 2 and about 6 mm.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles. The smoking articles may be arranged in different collations, depending on the total number of smoking articles. Containers formed from blanks according to the present invention may hold smoking articles of the same type or brand, or of different types or brands. In addition, both filter-less smoking articles and smoking articles with various filter tips may be contained, as well as smoking articles of differing length (for example, between about 40 mm and about 180 mm), diameter (for example, between about 4 mm and about 9 mm). Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container. The length, width and depth of containers according to the invention may be such that the resultant overall dimensions of the container are similar to the dimensions of a typical disposable pack of twenty cigarettes.

Thus, it shall be appreciated that the total number and the arrangement of the smoking articles within the container shall generally directly impact the maximum width and depth of the container and, correspondingly the geometric features of certain blanks according to the invention as described above. In particular, in certain preferred embodiments, the size of the side portions of the dust flaps can be selected such as to ensure that the container can accommodate a predetermined number of smoking articles in a given arrangement. Accordingly, the skilled person shall appreciate how the present invention provides a valuable and versatile tool for designing and manufacturing containers suitable to receive substantially any number of smoking articles in any given arrangement.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

The surfaces of blanks according to the invention which correspond to exterior surfaces of containers may be printed, embossed, debossed or otherwise embellished with manufacturer or brand logos, trade marks, slogans and other consumer information and indicia.

Containers according to the present invention may hold smoking articles of the same type or brand, or of different types or brands. In addition, both filter-less smoking articles and smoking articles with various filter tips may be contained, as well as smoking articles of differing length (for example, between about 40 mm and about 180 mm), diameter (for example, between about 4 mm and about 9 mm). Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The length, width and depth of containers according to the invention may be such that the resultant overall dimensions of the container are similar to the dimensions of a typical disposable pack of twenty cigarettes.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

The exterior surfaces of containers according to the invention may be printed, embossed, debossed or otherwise embellished with manufacturer or brand logos, trade marks, slogans and other consumer information and indicia.

Containers according to the invention may be filled and assembled using conventional apparatus and methods, modified to include the step of forming one or more creasing lines in the blank, and optionally, the step of forming one or more ablated lines in the blank. The ablated lines may be produced using an ablation tool, such as a laser or a blade. A laser is particularly preferred as the ablation tool as it can allow for a wide variety of ablation profiles and configurations, with minimal adjustment of the laser tool being needed. For example, the laser may be repeatedly passed over a given portion of the blank to iteratively remove different amounts of material, allowing fora very finely controlled ablation profile. This is particularly beneficial if the fine ablated lines are required, with narrow widths. It is possible to accurately control the relative movement of the laser and the blank so as to form any type of pattern with varying removal intensity ("depth") over the ablation area.

The invention will be further described, by way of example only, with reference to the accompanying drawings in which.

Figure 1:
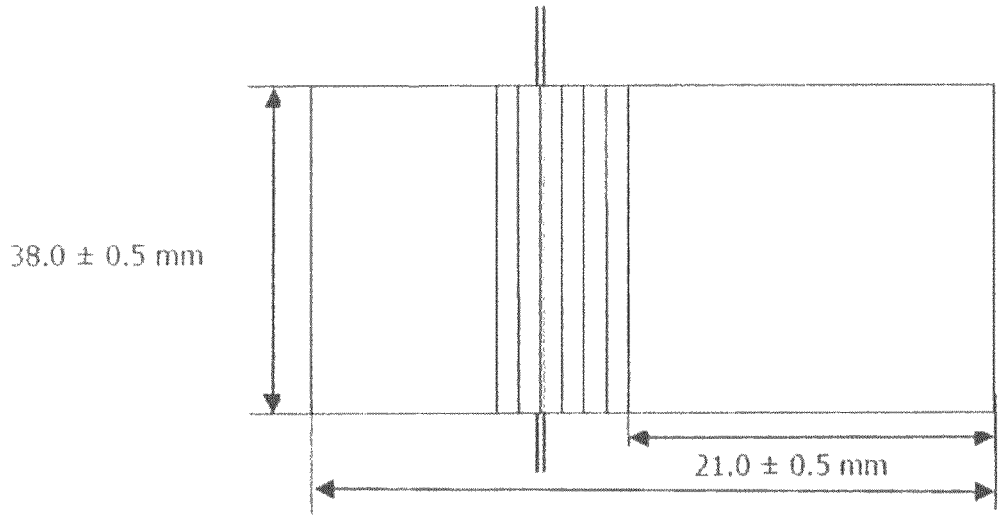
FIG. 1 depicts a sample portion of a laminar blank for use in determining the spring-back force of the blank.
Figure 2:
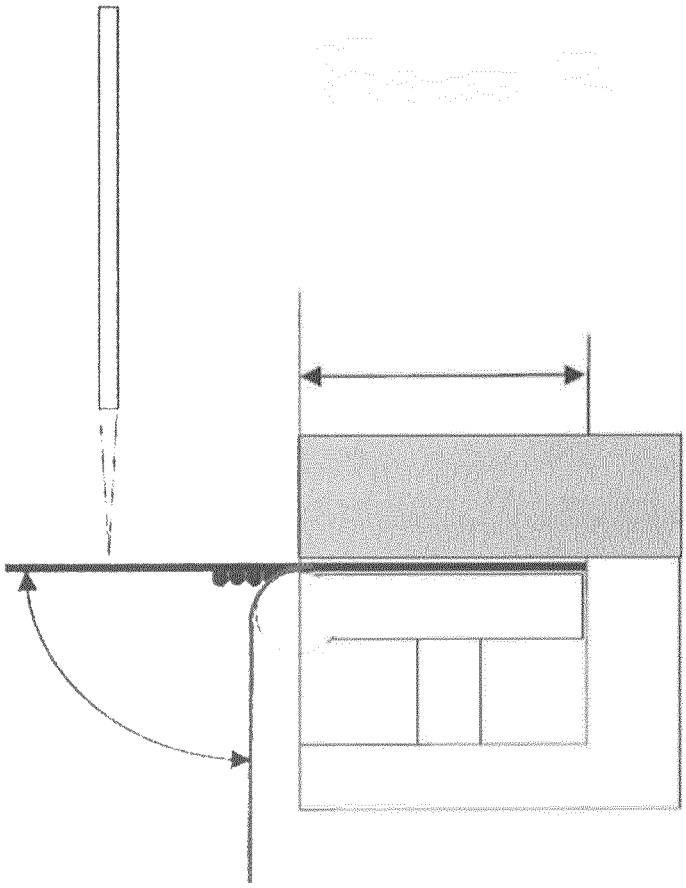
FIG. 2 depicts an apparatus for determining the spring-back force of a blank.
Figure 3:
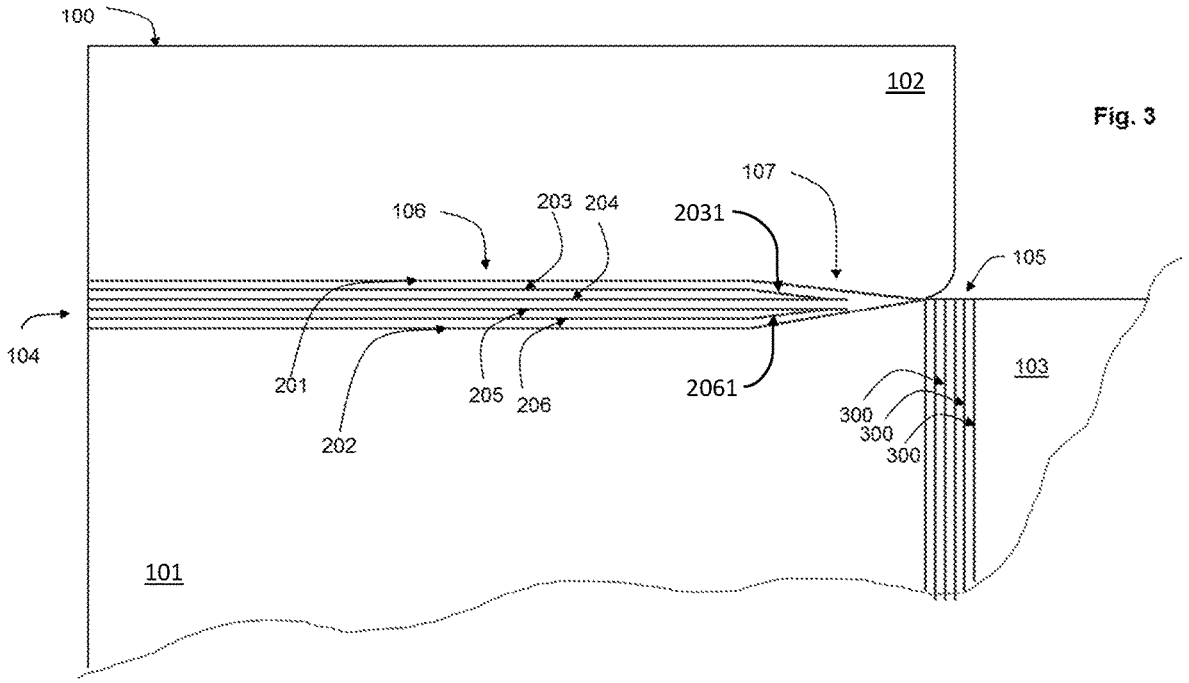
FIG. 3 shows a schematic top view of a detail of a first embodiment of a laminar blank for the manufacture of a container in accordance with the present invention.

FIG. 3 depicts the surface of a cardboard laminar blank 100, which has a thickness (T) of about 300 micrometres. It comprises a first wall panel 101 for forming a first planar wall of a container, a second wall panel 102 for forming a second planar wall of the container, and a third wall panel 103 for forming a third planar wall of the container. A first modified edge portion 104 connects the first wall panel 101 and the second wall panel 102. A second modified edge portion 105 connects the first wall panel 101 and the third wall panel 103. The longitudinal direction of the first modified edge portion 104 is substantially orthogonal to the longitudinal direction of the second modified edge portion 105. When the container is assembled from the blank, the first modified edge portion 104 and the second modified edge portion 105 form adjacent edge portions of the container meeting at a junction.

The inner surface of the first modified edge portion 104 defines a first ablation area. As shall be explained in more detail below, the ablation area comprises a plurality of ablated lines having a residual thickness less than the thickness (T) of the laminar blank. The ablated lines define areas of weakness, such that the blank 100 can be easily bent when assembling the container and rounded or bevelled edge portions of the container can be formed. Each of the ablated lines has a residual thickness of about 20 percent of the thickness T of the blank. The ablated lines are formed in the blank 100 by laser ablation.

The ablation area of the first modified edge portion 104 has a length in the longitudinal direction of the first modified edge portion 104 and a respective width that extends transversely to the length.

The ablation area of the first modified edge portion 104 comprises a first portion 106 and an end portion 107 extending from the first portion 106 and tapering from a width of the first portion 106 to a point at the junction with the second modified edge portion 105.

The ablation area of the first modified edge portion 104 comprises a first ablated line 201 and a second ablated line 202 which extend in parallel in the longitudinal direction of the first modified edge portion 104 within the first portion 106 of the ablation area. The first and the second ablated lines 201 and 202 taper over the end portion 107 to end at the junction point with the second modified edge portion 105.

The first ablated line 201 is arranged proximate to the first wall panel 101 and the second ablated line 202 is arranged proximate to the second wall panel 102. Further, the ablation area of the first modified edge portion 104 comprises four further ablated lines 203, 204, 205, 206 that extend in parallel in the longitudinal direction of the first modified edge portion 104 within the first portion 106 of the ablation area.

The pair of ablated lines formed by the ablated lines 204 and 205 extends in the longitudinal direction of the first modified edge portion 104 further into part of the tapering end portion 107 of the ablation area of the first modified edge portion 104. In contrast, the pair of ablated lines 203 and 206 comprises respective slanted sections 2031 and 2061 forming an angle of about 10 degrees with the ablated lines 204 and 205. As illustrated in FIG. 3, the ablated lines 203 and 206 are symmetrical with respect to the pair formed by the ablated lines 204 and 205.

The second modified edge portion 105 comprises a plurality of creasing lines 300 extending in the longitudinal direction of the second modified edge portion 105 over the whole length of the second modified edge portion 105. Thus, a corner portion of the first planar wall panel 101 is delimited by the substantially straight creasing line 300 of the second modified edge portion 105 and by the tapered portion of ablated line 201 of the first ablation area of the first modified edge portion 104.

Figure 4:
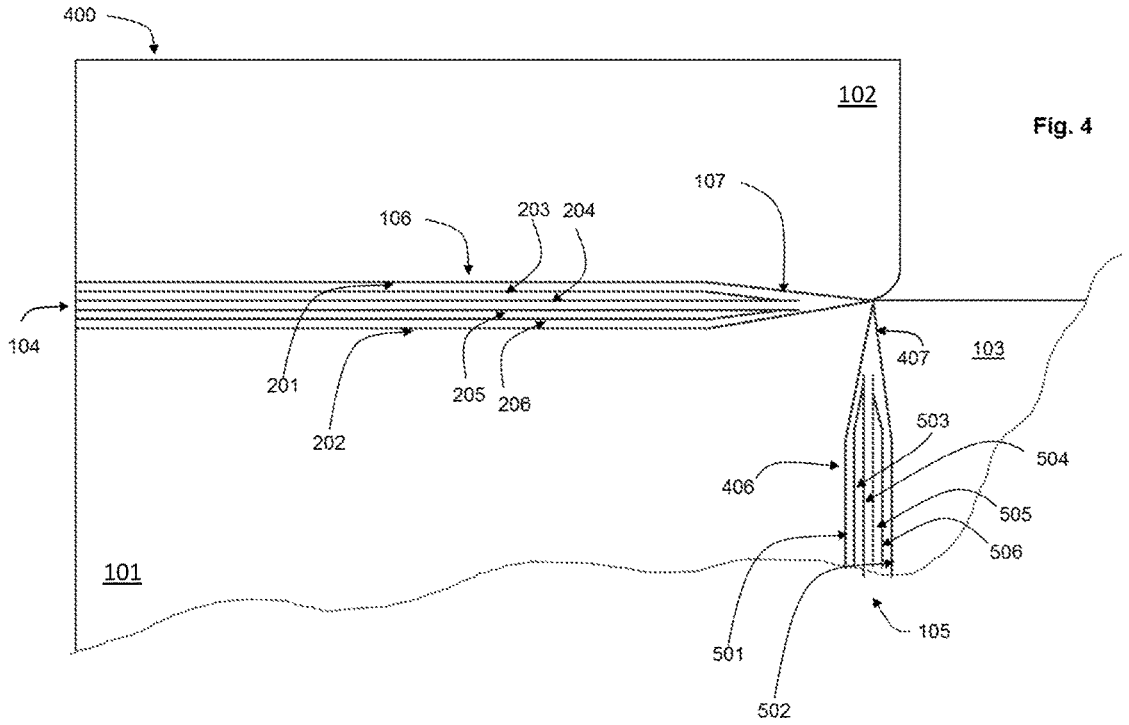
FIG. 4 shows a schematic top view of a detail of a second embodiment of a laminar blank for the manufacture of a container in accordance with the present invention.

FIG. 4 depicts the surface of another cardboard laminar blank 400. The cardboard laminar blank 400 will be described below only insofar as it differs from the cardboard laminar blank 100 and parts of the blank 400 having the same features and function of corresponding parts of the laminar blank 100 are referred to, wherever possible by the same numerals.

As illustrated in FIG. 4, the blank 400 differs from the blank 100 because the second modified edge portion 105 also comprises a first portion 406 and an end portion 407 extending from the first portion 406 and tapering from a width of the first portion 406 to a point at the junction with the first modified edge portion 104. The second modified edge portion 105 could be defined by a plurality of ablated lines. However, preferably the second modified edge portion is defined by a plurality of creasing lines 501, 502, 503, 504, 505, 506. The mutual arrangement of the creasing lines 501, 502, 503, 504, 505, 506 within the second modified edge portion 105 corresponds to the mutual arrangement of the ablated lines 201, 202, 203, 204, 205, 206 within the ablation area of the first modified edge portion 105 as described above.

Thus, in the blank 400 a corner portion of the first planar wall panel 101 is delimited by the tapered portion of creasing line 501 of the second modified edge portion 105 and by the tapered portion of ablated line 201 of the ablation area of the first modified edge portion 104.

Figure 5:
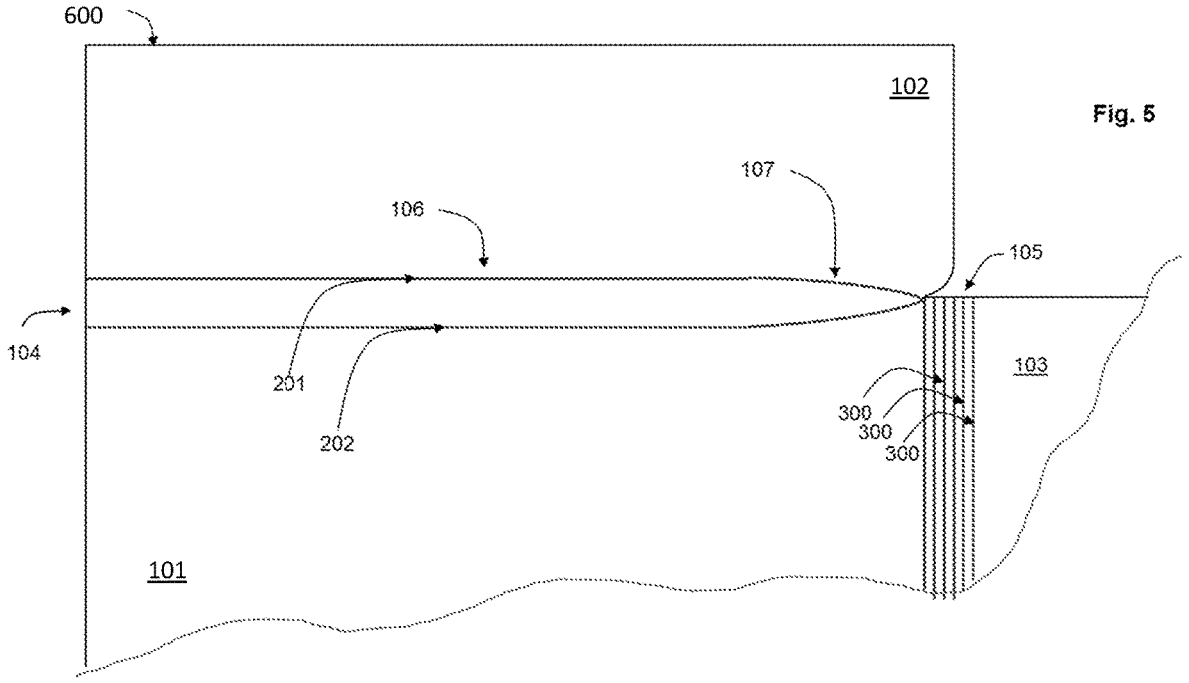
FIG. 5 shows a schematic top view of a detail of a third embodiment of a laminar blank for the manufacture of a container in accordance with the present invention.

FIG. 5 depicts the surface of another cardboard laminar blank 600. The cardboard laminar blank 600 will be described below only insofar as it differs from the cardboard laminar blank 100 and parts of the blank 600 having the same features and function of corresponding parts of the laminar blank 100 are referred to, wherever possible by the same numerals.

As illustrated in FIG. 5, the blank 600 differs from the blank 100 because the first modified edge portion 105 no longer comprises ablated lines 203, 204, 205 and 206. Consequently, when the blank 600 of FIG. 5 is folded to assemble a container, the first modified edge portion will have a substantially bevelled profile that is defined by ablated lines 201 and 202. This contrasts with the blank 100 of FIG. 4, for which the first modified edge portion will have a substantially curved profile that is defined by ablated lines 201, 202, 203, 204, 205 and 206.

The invention claimed is:

1. A container for consumer articles, the container being at least partially formed from a laminar blank, the laminar blank defining a portion of the container, the portion of the container comprising:

a first planar wall;

a second planar wall connected to the first planar wall by a first modified edge portion; and a third planar wall connected to the first planar wall by a second modified edge portion;

the longitudinal direction of the first modified edge portion being transverse to the longitudinal direction of the second modified edge portion; the first modified edge portion and the second modified edge portion forming, when the container is assembled from the laminar blank, adjacent edge portions of the container meeting at a junction;

wherein each of the first modified edge portion and the second modified edge portion has a length in the longitudinal direction of the respective modified edge portion and a respective width that extends transversely to the length;

wherein the first modified edge portion is defined by an ablation area on its inner surface, the ablation area comprising one or more ablated lines each having a residual thickness less than the thickness (T) of the laminar blank, the first modified edge portion further comprising a first portion and an end portion extending from the first portion, the end portion tapering from a width (W) of the first portion to a point at the junction with the second modified edge portion;

wherein the second modified edge portion is defined by a plurality of creasing lines in the laminar blank, wherein the one or more ablated lines comprises a first ablated line and a second ablated line, and wherein each of the first ablated line and the second ablated line comprises a slanted section extending over at least part of the tapering end portion of the first modified edge portion, along a direction forming a non null angle with the longitudinal direction of the first modified edge portion.

2. A container according to claim 1, wherein both of the first modified edge portion and the second modified edge portions comprise a respective first portion and a respective end portion extending from the respective first portion and tapering from a width of the respective first portion to a point at the junction with the other one of the first modified edge portion and the second modified edge portion.

3. A container according to claim 1, wherein the plurality of creasing lines extends in the longitudinal direction of the second modified edge portion over the whole length of the second modified edge portion.

4. A container according to claim 1, wherein the second modified edge portion is defined by at least four creasing lines in the laminar blank, the at least four creasing lines extending in the longitudinal direction of the second modified edge portion over the whole length of the second modified edge portion.

5. A container according to claim 1, wherein each ablated line has a residual thickness of less than about 50 percent of the thickness (T) of the laminar blank.

6. A container according to claim 1, wherein each ablated line has a residual thickness of at least about 5 percent of the thickness (T) of the laminar blank.

7. A container according to claim 1, further comprising a fourth planar wall connected to the first planar wall by a third modified edge portion, the longitudinal direction of the third modified edge portion being transverse to the longitudinal direction of the first modified edge portion and substantially parallel to the longitudinal direction of the second modified edge portion, such that, when the container is assembled from the laminar blank, the first modified edge portion and the third modified edge portion form adjacent edge portions of the container meeting at a second junction;

wherein the first modified edge portion comprises the first portion and two opposite end portions extending from the first portion, each end portion tapering from a width (W) of the first portion to a point at the junction with a respective one of the second and third modified edge portions (A2, A3).

8. A container according to claim 7, wherein the third modified edge portion (A3) is defined by a plurality of creasing lines in the laminar blank extending in the longitudinal direction of the third modified edge portion over the whole length of the third modified edge portion.

9. A container according to claim 1 containing smoking articles.

10. A container according to claim 1, wherein the first ablated line and the second ablated line extend in parallel in the longitudinal direction of the first modified edge portion within the first portion of the ablation area; and wherein each of the first and second ablated lines is arranged proximate to a respective one of the first planar wall and the second planar wall.

11. A laminar blank for forming a container for consumer articles, the laminar blank comprising:

a first planar wall;

a second planar wall connected to the first planar wall by a first modified edge portion; and a third planar wall connected to the first planar wall by a second modified edge portion;

the longitudinal direction of the first modified edge portion being transverse to the longitudinal direction of the second modified edge portion; the first modified edge portion and the second modified edge portion forming, when the container is assembled from the laminar blank, adjacent edge portions of the container meeting at a junction;

wherein each of the first modified edge portion and the second modified edge portion has a length in the longitudinal direction of the respective modified edge portion and a respective width that extends transversely to the length;

wherein the first modified edge portion is defined by an ablation area on its inner surface, the ablation area comprising one or more ablated lines each having a residual thickness less than the thickness (T) of the laminar blank, the first modified edge portion further comprising a first portion and an end portion extending from the first portion, the end portion tapering from a width (W) of the first portion to a point at the junction with the second modified edge portion; and wherein the second modified edge portion is defined by a plurality of creasing lines in the laminar blank, wherein the one or more ablated lines comprises a first ablated line and a second ablated line, and wherein each of the first ablated line and the second ablated line comprises a slanted section extending over at least part of the tapering end portion of the first modified edge portion, along a direction forming a non null angle with the longitudinal direction of the first modified edge portion.

* * * * *